US010761485B2

(12) United States Patent
Denden et al.

(10) Patent No.: US 10,761,485 B2
(45) Date of Patent: Sep. 1, 2020

(54) STRIKE MODE SELECTOR FOR A WATCH OR TIMEPIECE

(71) Applicant: Blancpain SA, Le Brassus (CH)

(72) Inventors: Mehdi Denden, Les Rousses (FR); Julien Peter, Gollion (CH)

(73) Assignee: Blancpain SA, Le Brassus (CH)

( * ) Notice: Subject to any disclaimer, the term of this patent is extended or adjusted under 35 U.S.C. 154(b) by 246 days.

(21) Appl. No.: 16/043,785

(22) Filed: Jul. 24, 2018

(65) Prior Publication Data

US 2019/0033788 A1 Jan. 31, 2019

(30) Foreign Application Priority Data

Jul. 25, 2017 (EP) ..... 17182975

(51) Int. Cl.

| | |
|---|---|
| ***G04B 21/04*** | (2006.01) |
| ***G04B 21/10*** | (2006.01) |
| ***G04B 21/06*** | (2006.01) |
| ***G04B 23/02*** | (2006.01) |
| ***G04B 21/12*** | (2006.01) |

(52) U.S. Cl.

CPC ..... *G04B 21/04* (2013.01); *G04B 21/06* (2013.01); *G04B 21/10* (2013.01); *G04B 21/12* (2013.01); *G04B 23/026* (2013.01)

(58) Field of Classification Search

CPC ..... G04B 21/02; G04B 13/00; G04B 9/02; G04B 23/12; G04B 19/02; G04B 21/14

See application file for complete search history.

(56) References Cited

U.S. PATENT DOCUMENTS

| | | | | |
|---|---|---|---|---|
| 7,320,543 | B2 * | 1/2008 | Goeller | G04B 21/12 368/100 |
| 7,330,403 | B2 * | 2/2008 | Goeller | G04B 21/12 368/267 |
| 7,896,542 | B2 * | 3/2011 | Born | G04B 5/12 368/148 |

(Continued)

FOREIGN PATENT DOCUMENTS

| | | |
|---|---|---|
| CH | 704 590 A2 | 9/2012 |
| CH | 706 080 B1 | 8/2013 |
| CH | 711 258 A2 | 12/2016 |

OTHER PUBLICATIONS

European Search Report dated Feb. 15, 2018 in European Application 17182975.7 filed on Jul. 25, 2017 (with English Translation of Categories of Cited Documents).

*Primary Examiner* — Sean Kayes

(74) *Attorney, Agent, or Firm* — Oblon, McClelland, Maier & Neustadt, L.L.P.

(57) ABSTRACT

Striking mechanism for a watch including:

an hour snail driven by a movement, a strike wheel set including a detent ratchet and a repeating rack pinion, a pivoting hour-rack for reading this snail and driving this pinion, a click set in motion at each passing strike to drive this detent ratchet, with a mode selector mechanism for selection by the user of a particular strike mode, among distinct modes including a silent mode, defining the angular position of a cam having an external profile, wherein, in silent mode, the largest radius pushes back a beak of a silencing lever, to orient it into a position where its main arm moves this click away from this ratchet in order to disable every passing strike.

14 Claims, 17 Drawing Sheets

(56) References Cited

U.S. PATENT DOCUMENTS 8,565,045 B2 * 10/2013 Goeller ..... G04B 21/12
368/267
8,570,841 B2 * 10/2013 Goeller ..... G04B 11/024
368/244
8,599,651 B2 * 12/2013 Goeller ..... G04B 21/12
368/244

* cited by examiner

STRIKE MODE SELECTOR FOR A WATCH OR TIMEPIECE

This application claims priority from European patent application No. 17182975.7 filed on Jul. 25, 2017, the entire disclosure of which is hereby incorporated herein by reference.

FIELD OF THE INVENTION

The invention concerns a striking mechanism for a watch or timepiece comprising a movement, said striking mechanism comprising at least one reference wheel set arranged to be driven by a said movement and wherein at least one said reference wheel set is an hour snail, at least one strike drive wheel set including a detent ratchet and a repeating rack pinion, said striking mechanism including at least one pivoting part arranged to cooperate indirectly with an output of a said movement, including a feeler arm for reading a said reference wheel set and a rack for driving said repeating rack pinion, one of said pivoting parts being an hour-rack arranged to cooperate with said hour snail, said striking mechanism further including a main click arranged to be set in motion at each passing strike and to drive said detent ratchet, and said striking mechanism being able to operate in at least two distinct strike modes including a silent mode, wherein said striking mechanism includes a strike selector mode, comprising a user-accessible selector which allows the user to choose which strike mode to use and controls the angular position of at least one cam, which has particular positions for different modes, said cam having a continuous, external, feeler arm support profile, arranged to cooperate with a beak comprised in a silencing lever, and which has an area of larger radius corresponding to said silent mode, arranged to orient said silencing lever into a position where a main arm of said silencing lever moves said main click away from said detent ratchet, in order to disable every passing strike, in silent mode.

The invention also concerns a watch comprising a movement including an output for releasing the passing strike function by the movement, this movement being arranged to drive at least one reference wheel set, and the watch includes at least one such striking mechanism.

The invention also concerns a timepiece comprising a movement including an output for releasing the passing strike function by the movement, this movement being arranged to drive at least one reference wheel set, and the timepiece includes at least one such striking mechanism.

The invention concerns the field of striking mechanisms for watches, timepieces or music boxes.

BACKGROUND OF THE INVENTION

Timepiece striking mechanisms are large complications, which are complex as regards not only the number and complexity of the kinematics of their components, but also their possible operating modes. Choosing between the various strike modes is in itself an additional complication, which employs expensive components, such as column wheels or the like, and which takes up significant space inside the watch or timepiece case, which often has a set of notches for this selection function. The interface between the selection mechanism and the exterior of the case must also enjoy a particular seal tightness. Managing safety features between the various modes is always complex.

For watches that have additional complications, such as minute repeaters, managing safety features is very complex, and it is difficult to stop the passing strike function to allow a minute repeater to play, or conversely, to stop a minute repeater being released as a passing strike approaches, to prevent a minute repeater being released again when a repeater cycle has just started, to prevent an adjustment to the motion work during a striking function, etc., as these safety means generally employ a large number of isolators, which further complicates the mechanism and the risk of interference.

Swiss Patent No CH706080B1 in the name of PATEK PHILIPPE discloses a timepiece including a case enclosing a mechanical timepiece movement, including a repeater mechanism that can be released automatically by the mechanical timepiece movement, wherein the repeater mechanism includes a release lever provided with a click which is pivotably mounted on said release lever and arranged to move into engagement with the toothing of a detent ratchet comprised in the fusee of the repeater mechanism, so that, on automatic release, a nut driven by the motion work of the movement, preferably integral with the cannon pinion of the movement, causes the release lever to pivot towards the detent ratchet, and so that, when the release lever drops, the click beak drives the detent ratchet in rotation; the repeater mechanism includes a strike mode selection mechanism. This strike mode selection mechanism includes an operating member that is accessible from outside the timepiece and formed of a slide-piece, mounted to slide in a back-and-forth movement on the periphery of the timepiece case between at least two positions, one corresponding to a strike mode and the other to the silent mode.

CH Patent Application No 704590A1 in the name of MONTRES BREGUET SA discloses an isolating mechanism for a timepiece, including, on the one hand, a timepiece movement and, on the other hand, at least one striking mechanism including feeler arms for reading time information, on time references driven by said timepiece movement. This isolating mechanism includes at least a first isolator, arranged to cooperate with a control mechanism comprised in the timepiece, in order, in a first armed position, to adopt a stop position that prevents the time information feeler arms from searching for information on the time references, and, in a second unarmed position, to allow the feeler arms to pass and come into contact with the time references.

Swiss Patent No CH711258A2 in the name of RICHEMONT discloses a selector device for a timepiece striking mechanism, the striking mechanism being drivable by a strike train and configured to be placed in a 'strike' mode, in which the striking mechanism is always activated, a 'night-time' mode wherein the striking mechanism is disabled only for a predetermined period of the day, or a 'silent' mode in which the striking mechanism is always disabled; the selector device including: a cam completing one rotation in 24 hours and having the profile required for said predetermined period, a first lever, configured to switch between a first position, in which the first lever does not cooperate with the cam, so that the striking mechanism is in 'strike' mode, and a second position in which the feeler arm cooperates with the cam so that the striking mechanism is in 'night-time' mode; and a second lever, configured to switch between a first position, in which the striking mechanism is connected to the strike train, and a second position, in which the striking mechanism is disconnected from the strike train so that the striking mechanism is in 'silent' mode. This selector device comprises a push lever that can be actuated to tilt the first lever and the second lever to place the striking mechanism in one of the 'strike', 'night-time' or 'silent' modes.

SUMMARY OF THE INVENTION

The invention proposes to achieve strike mode selection in a simple and reliable manner, compatible with the implementation of efficient safety means of average complexity.

To this end, the invention concerns a striking mechanism according to claim 1.

The invention also concerns a watch comprising a movement including an output for releasing the passing strike function by the movement, this movement being arranged to drive at least one reference wheel set, and the watch includes at least one such striking mechanism.

The invention also concerns a timepiece comprising a movement including an output for releasing the passing strike function by the movement, this movement being arranged to drive at least one reference wheel set, and the timepiece includes at least one such striking mechanism.

BRIEF DESCRIPTION OF THE DRAWINGS

Other features and advantages of the invention will appear upon reading the following detailed description, with reference to the annexed drawings, in which:

FIGS. 1 and 2 represent the striking mechanism according to the invention in a petite sonnerie mode.

FIGS. 3 and 4 represent the striking mechanism according to the invention in a grande sonnerie mode.

FIGS. 5 and 6 represent the striking mechanism according to the invention in a silent mode.

FIGS. 7 and 8 represent the striking mechanism according to the invention stopped in grande sonnerie mode.

FIGS. 13 and 14 represent the striking mechanism according to the invention in petite sonnerie mode with the first tune.

FIGS. 15 and 16 represent the striking mechanism according to the invention in grande sonnerie mode with the second tune.

FIGS. 17 and 18 represent the striking mechanism according to the invention in silent mode, where it is possible to play the second tune by means of the minute repeater control device.

FIGS. 20 and 21 represent the striking mechanism according to the invention in petite sonnerie mode with the first tune.

FIGS. 22 and 23 represent the striking mechanism according to the invention in petite sonnerie mode with the second tune.

FIGS. 24 and 25 represent the striking mechanism according to the invention in grande sonnerie mode with the first tune.

FIGS. 26 and 27 represent the striking mechanism according to the invention in grande sonnerie mode with the second tune.

FIGS. 28 and 29 represent the striking mechanism according to the invention in silent mode, where it is possible to play the first tune by means of the minute repeater control device.

DETAILED DESCRIPTION OF PREFERRED EMBODIMENTS

Figure 2:
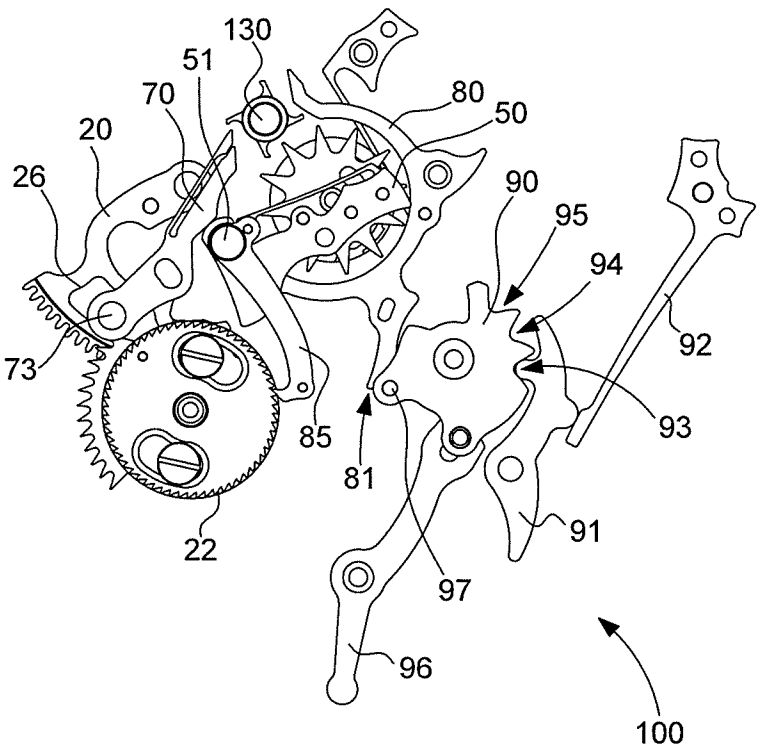
FIGS. 1 to 8 schematically represent, two-by-two and in a plan view, the striking mechanism according to the invention in the same position, the odd Figures showing the back side, and the even Figures showing the front side; not all the components are represented, only those which are essential for performing the illustrated function are visible.

The invention concerns a watch 1000 or a timepiece 2000 including at least one specific striking mechanism 100. This timepiece 2000 may be a music box or include a music box.

The work by François LECOULTRE entitled *Les montres compliquées* (A Guide to Complicated Watches), Editions Horlogères, Bienne (Switzerland), 1985, ISBN 2-88175-000-1, explains, in detail, the basic mechanisms forming striking mechanisms, at pages 97 to 205 (pages 85 to 181 of the English edition), in different chapters:

repeating watches,
old repeating watches,
modern quarter-repeater,
simplified repeater,
half-quarter repeater,
Breguet half-quarter repeater,
five minute-repeater,
minute-repeaters
clock watches Unless necessary, these basic mechanisms will not be discussed here in detail, since striking mechanism specialists will know how to find the composition of such mechanisms in this universal reference work, in particular in the aforementioned last two chapters.

Striking mechanism 100 according to the invention includes, in a conventional manner, at least one reference wheel set 1, and preferably a plurality of reference wheel sets 1, including time reference snails and/or stars, and particularly a minute snail, a quarter snail and an hour snail 190.

This striking mechanism 100 also includes at least one strike drive wheel set 2, as explained in particular in the chapter on 'Clock Watches' in 'A Guide to Complicated Watches' and visible, in particular, in FIG. 40 of this book. This strike drive wheel set 2 conventionally includes a detent ratchet 22 and a repeating rack pinion 24.

Striking mechanism 100 cooperates with a movement 200, which drives the reference wheel set(s) 1, and a specific output 3 of which is illustrated in the Figures, in the non-limiting form of a star 130 for releasing the strike by the movement, fitted onto a cannon-pinion, and including four teeth, in order to lift, at each quarter hour, an intermediate lever for release by the movement, referred to hereinafter as gathering pallet 70.

Striking mechanism 100 includes at least one pivoting part, which is arranged to cooperate indirectly, via this gathering pallet 70, with the output 3 of movement 200, and particularly includes a feeler arm for reading such a reference wheel set 1 and a rack for driving repeating rack pinion 24. One of these pivoting parts is an hour-rack 20 arranged to cooperate with the hour snail 190. Striking mechanism 100 further includes a main click 85, which is arranged to be set in motion upon each passing strike, and to drive, when possible, detent ratchet 22.

Striking mechanism 100 according to the invention includes all or part of the main strike modes: grande sonnerie, petite sonnerie, alarm, silent, and more particularly includes a minute repeater mechanism, particularly a minute repeater mechanism, notably as explained in the 'Minute Repeater' chapter of 'A Guide to complicated watches'.

The non-limiting variant illustrated by the Figures includes three strike modes: grande sonnerie (GS), petite sonnerie (PS), silent (S), and a minute repeater. This minute repeater mechanism includes, in particular, an hour-rack 20, arranged to cooperate via a feeler arm 29 comprised therein, with an hour-snail 190.

Striking mechanism 100 includes a mode selector mechanism 9. This mode selector mechanism 9 comprises a user-accessible selector 96 which allows the user to choose which strike mode to use, and which controls the angular position of at least one cam 90.

Mode selector mechanism 9 includes at least one cam 90, which may have as many specific positions as there are designated modes of the striking mechanism, as in the variant illustrated by the Figures, or which includes positions specific to only some of these modes. The illustrated variant represents a flat cam 90, which includes three notched portions each corresponding to one of the selectable modes: 93 petite sonnerie, 94 grande sonnerie, 95 silence.

More particularly, according to the invention, the notched portions are notches of variable size, requiring increasing force in one of the two directions of operation. More particularly, one particular notch, for example a central notch, is larger than the end notches, to ensure safety by preventing the user from inadvertently changing from one strike mode to another.

Cam 90 occupies particular positions for the different modes. This cam 90 has a continuous, external, feeler arm support profile 98, which is arranged to cooperate with a beak 61 comprised in a silencing lever 60. This external profile 98 includes an area of larger radius 98S corresponding to silent mode, which is arranged to orient silencing lever 60 into a position where a main arm 64 of silencing lever 60 moves main click 85 away from detent ratchet 22, in order to disable every passing strike in silent mode.

It is understood that the invention is suitable for selection of an even higher number of distinct modes, in particular when a distinction has to be made between different tunes played, for example in order to differentiate between the quarters struck, or the different gongs played, as in European Patent Application No. EP2947523B1 by the same Applicant, when incorporating an alarm mechanism according to European Patent Application EP15190808.4 by the same Applicant, a safety mechanism for selection and/or release of a strike or tune according to European Patent Application No. EP15168700.1 by the same Applicant, a tune selection mechanism with an uncouplable lifting piece according to European Patent Application No. EP15183110.4 by the same Applicant, or a carillon striking mechanism according to European Patent Application No EP16206572.6 by the same Applicant.

Cam 90 can thus include multiple notches: GS tune A, GS tune B, PS tune A, PS tune B, S, and/or also: GS gong A, GS gong B, PS gong A, PS gong B, S. When there are too many different modes for a single cam, mode selector mechanism 9 can include a plurality of cams 90, especially superposed cams, each relating to some of these modes, for example with a particular tune, or a particular gong, or otherwise.

Such an arrangement makes it possible, in particular, to distinguish between the strike modes by the tunes played and/or by the gongs used. For example, grande sonnerie mode corresponds to a first tune and/or a first set of gongs, and petite sonnerie mode corresponds to a second tune and/or a second set of gongs.

It is understood that different cams 90 can be superposed, especially coaxially, or juxtaposed in one plane, and especially arranged in series.

In addition to mode selection, intended to ensure that only one mode selected by the user is performed by striking mechanism 100, mode selector mechanism 9 disables the striking mechanism in silent mode by moving the clicks away from strike drive wheel set 2, and prevents access by the hour-rack to the corresponding snail.

In particular, striking mechanism 100 includes a minute repeater with a minute repeater control device 4 including a repeater click 40, which is arranged to drive detent ratchet 22 once said hour-rack 20 has performed a reading on hour-snail 190. And, in silent mode, the main arm 64 of silencing lever 60 allows repeater click 40 access to detent ratchet 22, provided the energy available is sufficient to complete a striking function.

In a particular embodiment, striking mechanism 100 includes a grande sonnerie mode for the passing strike of each hour and of each quarter hour, repeating the hour at the quarter hour, and a petite sonnerie mode for the passing strike of each hour and of each quarter hour without repeating the hour at the quarter hour. Striking mechanism 100 thus includes a petite sonnerie lever 80, which is arranged to cooperate by bearing on a cam pin 97 comprised in cam 90 of selector mechanism 9, in order, when the petite sonnerie mode is selected, to orient petite sonnerie lever 80 into a position in which the latter prevents hour-rack 20 from moving towards hour snail 190, to prevent the hour being struck at the quarter hours.

When, in this same arrangement, the grande sonnerie mode is selected, cam pin 97 orients petite sonnerie lever 80 into another position in which the latter allows hour-rack 20 to move towards hour-snail 190, to allow the hours to be struck automatically on the quarter hours.

To distinguish between the passing strike of the hours and the quarter hours, striking mechanism 100 advantageously comprises, coaxial to a four-tooth star 130 driven by output 3 and which is arranged to automatically release strikes on the quarter hours, a tear-shaped hour cam 131, comprising a tip 132 which is arranged to lift petite sonnerie lever 80 and to allow hour-rack 20 to move towards hour-snail 190.

The operation of mode selector mechanism 9 does not hinder operation of the minute repeater, and especially in silent mode, except when, advantageously, striking mechanism 100 includes a particular stopping function arranged to prevent any striking function being performed if the amount of energy available is insufficient to ensure that the striking function is completed: striking mechanism 100 then advantageously comprises a stopping mechanism 5, which is arranged to prevent any striking function being performed, in order to avoid the risk presented by certain wheel sets stopping in intermediate positions, which could cause collisions on restarting. It is only when the stopping function is activated that operation of the minute repeater is also prohibited.

This stopping mechanism 5 is arranged to pivot a strike reversing lever 59 when the available energy is insufficient to complete a striking function. This strike reversing lever 59 controls the pivoting of a strike uncoupling lever 55, which is arranged to prevent access by repeater click 40 to detent ratchet 22 when the available energy is insufficient to complete a striking function, and to move main click 85 away from detent ratchet 22 when the available energy is insufficient to complete a striking function.

Mode selector mechanism 9 is preferably designed to avoid the use of a notch system on the watch case, which is standard in the prior art: to this end, a selector lever 96 advantageously controls, particularly via an articulated connection as seen in the Figures, the pivoting of cam 90, or cams 90 when there are more than one. More particularly, a cam jumper 91, associated with a cam jumper spring 92 for holding it in position, includes a selector finger 99, which cooperates with one of the notches of cam 90. This jumper 91 and its spring 92 have a dual function: allowing the user to feel the change of notch, and providing certainty of completion of the selection manoeuvre, with return to a clear position corresponding to one of the modes, and never to an intermediate position. Advantageously, spring 92 is oversized to ensure safety, and especially to overcome the friction forces of the gasket in the watch case.

This cam 90 also includes a cam pin 97, which is arranged to form a stop for a petite sonnerie lever 20, whose function will be explained hereinafter. In addition to the mode selection notches, cam 90 advantageously comprises a continuous external profile 98 including at least two feeler arm support areas, arranged to cooperate with a beak 61 of a silencing lever 60:an area of larger radius 98S corresponding to silent mode, and an area of smaller radius 98AGS corresponding to a stoppage in grande sonnerie mode, when the stopping function and the grande sonnerie mode exist.

Mode selection mechanism 9 can be used for different striking mechanisms. Its interactions with the conventional components of a striking mechanism 100 including a minute repeater mechanism are illustrated in a particular arrangement which is detailed below, those skilled in the art who specialize in striking mechanisms for mechanical watches or timepieces, will know how to transpose them to any mechanisms presenting variants.

This striking mechanism 100 is first displayed without the stopping mechanism.

Figure 1:
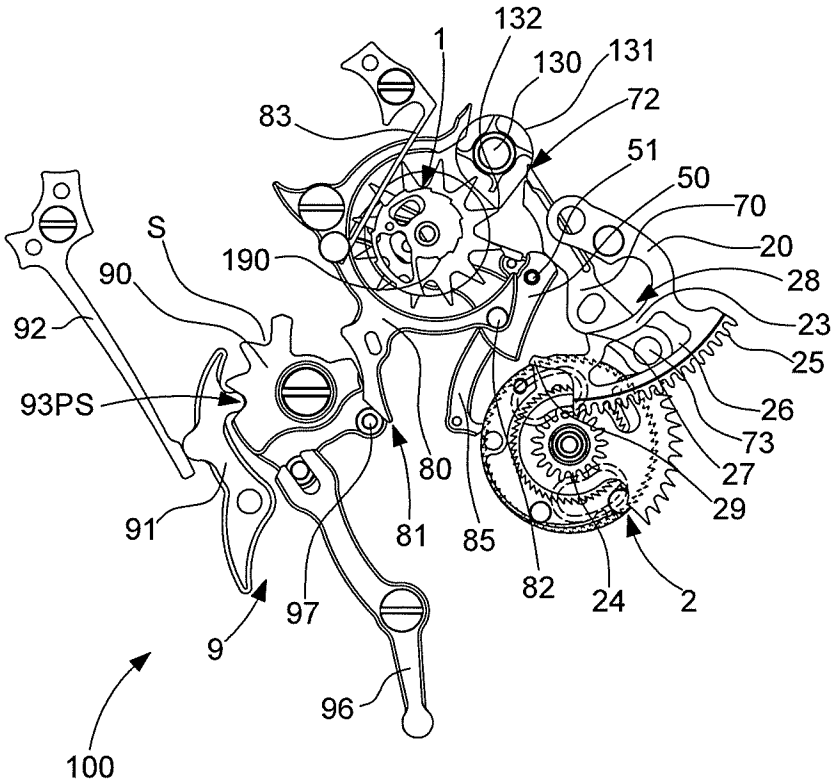

FIGS. 1 and 2 show the mode selector mechanism 9 in the indexing position corresponding to petite sonnerie notch 93, which strikes the full hours on passing, and the quarter hours only on passing. The usual quarter-rack and quarter-snail are not represented, in order to simplify the explanation of operation.

Star-wheel 130, arranged in proximity to reference wheel sets 1, is arranged to move into cooperation, every quarter hour, with a beak 72, especially an elastic beak, comprised in strike release gathering pallet 70.

This quarter-rack 20 includes a feeler arm 29 arranged to feel an hour-snail 190, and a rack 25 arranged to cooperate with a repeating rack pinion 24 comprised in a strike drive wheel set 2. Hour-rack 20 further includes, set back with respect to feeler arm 29, a rib 23 which ends, on the same side as feeler arm 29, in a flat abutment portion 27.

Strike drive wheel set 2 includes, in a conventional manner, a detent ratchet 22, which is arranged to cooperate, either with a main strike click 85, or a minute repeater release click 40, provided with a pin 41, and comprised in a minute repeater control device 4, wherein this latter click 40 cooperates with a spring 43. The pivoting of strike release gathering pallet 70 causes the pivoting of a lever 50 for release by the movement, which carries a thrust spring 52, which rests on main strike click 85, which is also carried by release lever 50.

A conventional petite sonnerie lever 80 carries a banking pin 82. This petite sonnerie lever 80, which is returned by an uncoupling spring 83 fixed to a plate, includes an uncoupling beak 81, which is arranged to rest on a cam pin 97 comprised in cam 90.

Petite sonnerie lever 80 faces hour-rack 20 during the angular travel of the latter, and banking pin 82 is at the level of rib 23 of hour-rack 20, on the same radius, which allows it to cooperate in abutment with flat portion 27 of hour-rack 20, and to immobilise the latter by preventing it from reaching hour-snail 190, so that the hour strike is not repeated on each quarter hour, in accordance with the operation specific to the petite sonnerie mode.

In order to ensure that the hour is struck on the full hour, star-wheel 130 is integral with a tear-shaped hour cam 131, whose tip 132 is arranged to lift petite sonnerie lever 80, and thus its banking pin 82, to allow feeler arm 29 of hour-rack 20 to pass in order to read hour-snail 190.

Figure 4:
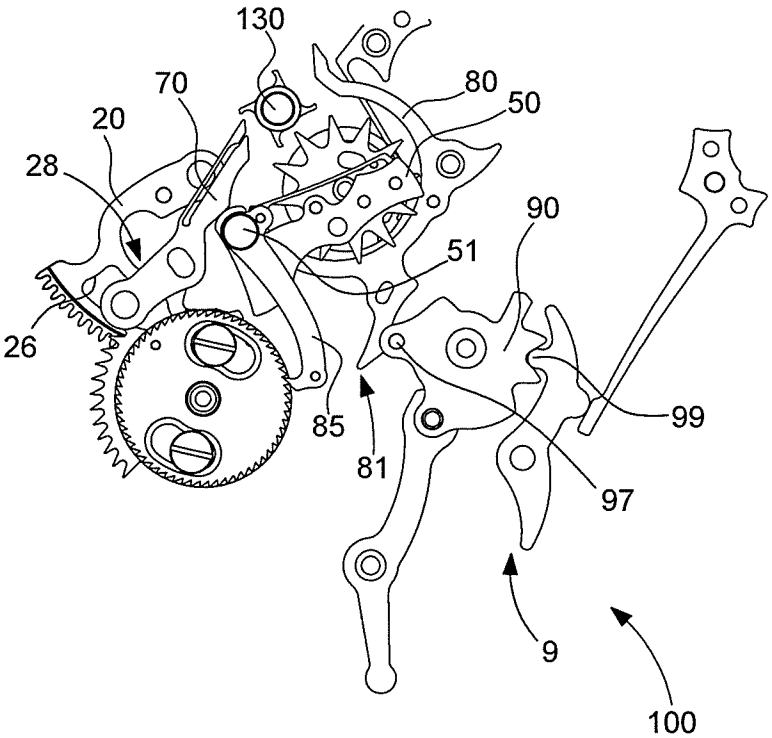
Figure 3:
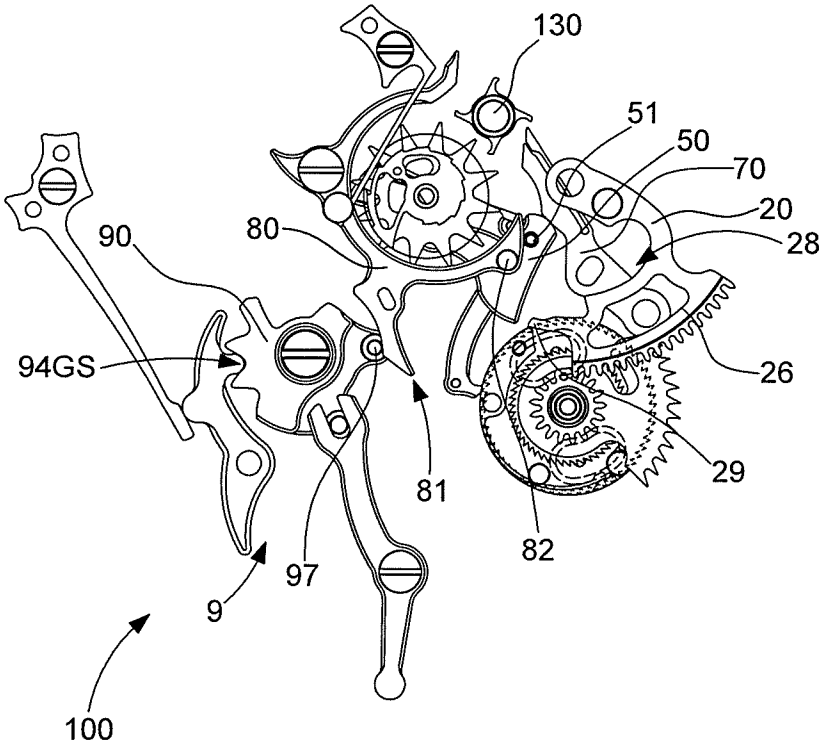

FIGS. 3 and 4 show mode selector mechanism 9 in the indexing position corresponding to grande sonnerie notch 94, which strikes the full hours on passing, and repeats the hour and strikes the quarter-hours on passing. The usual quarter-rack and quarter-snail are not represented. Cam pin 97 bears on petite sonnerie lever 80 at a greater distance from the end of uncoupling beak 81 than in the case of the petite sonnerie, and consequently banking pin 82 is no longer at the level of rib 23, or of flat portion 27 of hour-rack 20, but is at the level of recess 28, which allows hour-rack 20 to pivot freely towards hour-snail 190 at every quarter hour.

For operation in silent mode, striking mechanism 100 includes a grande sonnerie and petite sonnerie isolator, hereinafter referred to as silencing lever 60, which includes, at a first end, a reading beak 61 arranged to cooperate with one of peripheral areas 98 of mode selection cam 90, and at a second end 62, a main arm 64, which is arranged to stop a main click pin 86, comprised in main strike click 85. This silencing lever 60 includes, in its median part in proximity to its pivot, a silencing pin 63.

Spring 65 constrains silencing lever 60 via pin 63, so that the lever is always in contact with cam 90 via its beak 61. When the selected mode is silent mode, this silencing lever 60 pivots and its part 62 moves to disconnect click 85 from ratchet 22. Cam pin 97 is in contact with uncoupling beak 81 of petite sonnerie lever 80. During a minute repeater function (in petite sonnerie mode), a lever (not represented in the Figures) forms the link between control device 4 and the hole in lever 80, so that hour-rack 20 can fall onto hour-snail 190 of component 1.

Silencing lever 60 is seen in FIGS. 5 to 11, which also include a stopping mechanism 5, which essentially comprises a strike uncoupling lever 55. Striking mechanism 100 thus includes silencing lever 60 and strike uncoupling lever 55, which are partially superposed and each arranged to hinder access by a specific click to ratchet 22 of strike drive wheel set 2. Indeed, strike uncoupling lever 55 includes a stop arm 56, which is arranged to stop a repeater click pin 41, comprised in a minute repeater release click 40, of minute repeater control device 4.

The Figures show the particular arrangement of main click 85 and of minute repeater release click 40, which are both located on the same side of strike drive wheel set 2 and its ratchet 22, between mode selection cam 90 and ratchet 22. This arrangement is particularly advantageous, due to its particularly reduced volume and the short distances between the various components, which means that stiffer levers can be used, and it allows for the design of a stopping mechanism which is both compact, reliable and efficient. This arrangement is made possible, in particular, by the insertion of release lever 50 between the gathering pallet or first strike release lever 70, and main click 85: this release lever 50 carries the articulation of main click 85, and includes spring 52 which pushes on the click; it allows main click 85 to be positioned on the same side as minute repeater release click 40 with respect to ratchet 22, it reverses the direction of pivoting of main click 85 compared to a standard assembly in which the latter is meshed directly in gathering pallet 70, and, in particular, allows energy to be saved by precisely managing the engagement and disengagement of main click 85 with respect to ratchet 22. More particularly, main click 85 and minute repeater release click 40 are substantially aligned as a result of this novel arrangement, and silencing lever 60 and strike uncoupling lever 55 can be superposed, in an almost collinear manner, which considerably simplifies the control and stopping of the striking functions, by reducing the number of components and the manoeuvring travels of these components.

Figure 6:
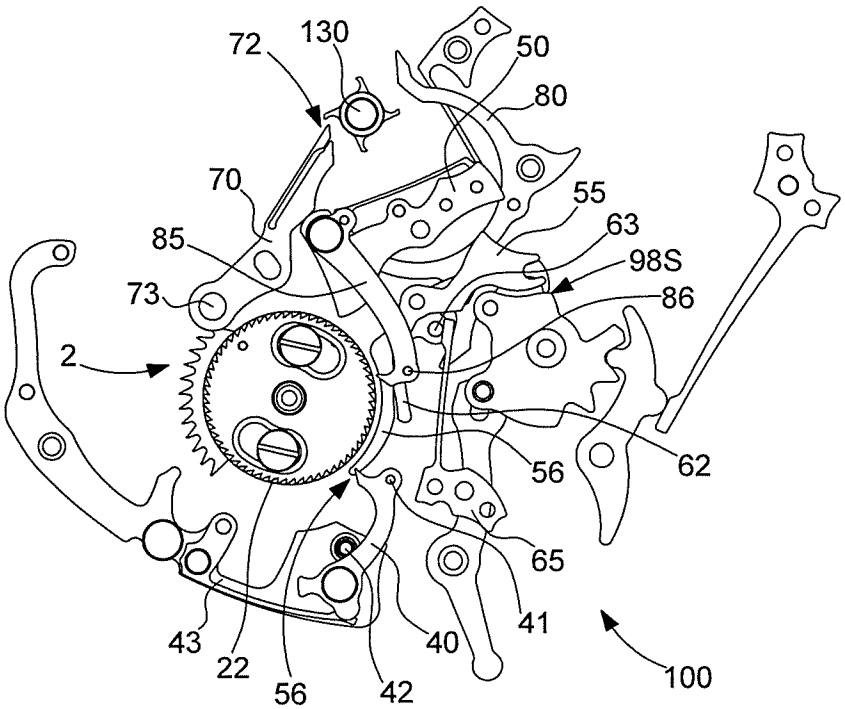
Figure 5:
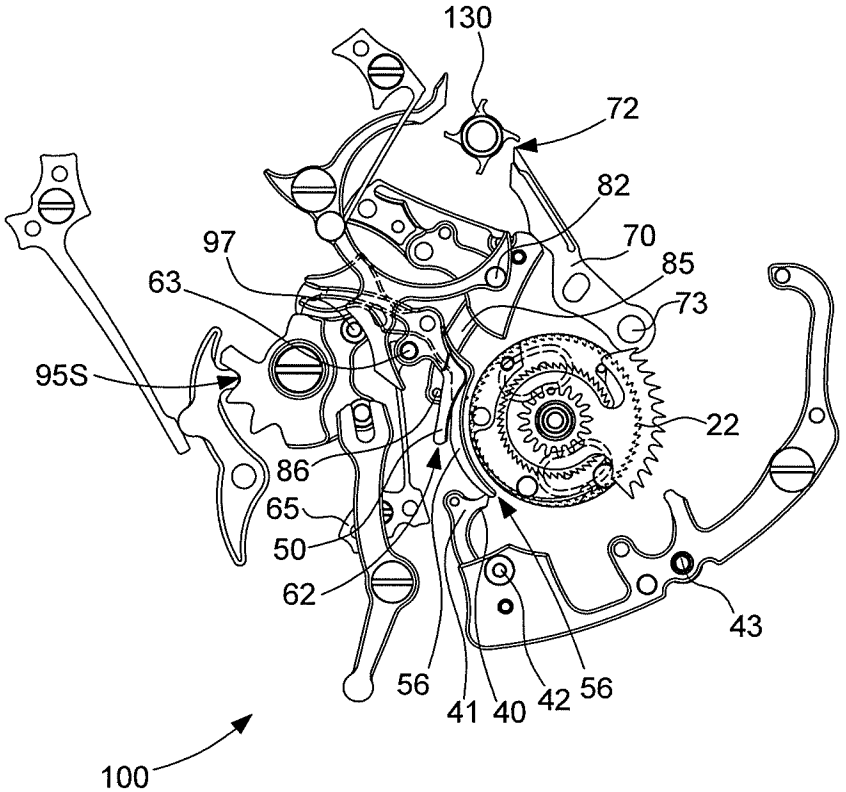
Figure 8:
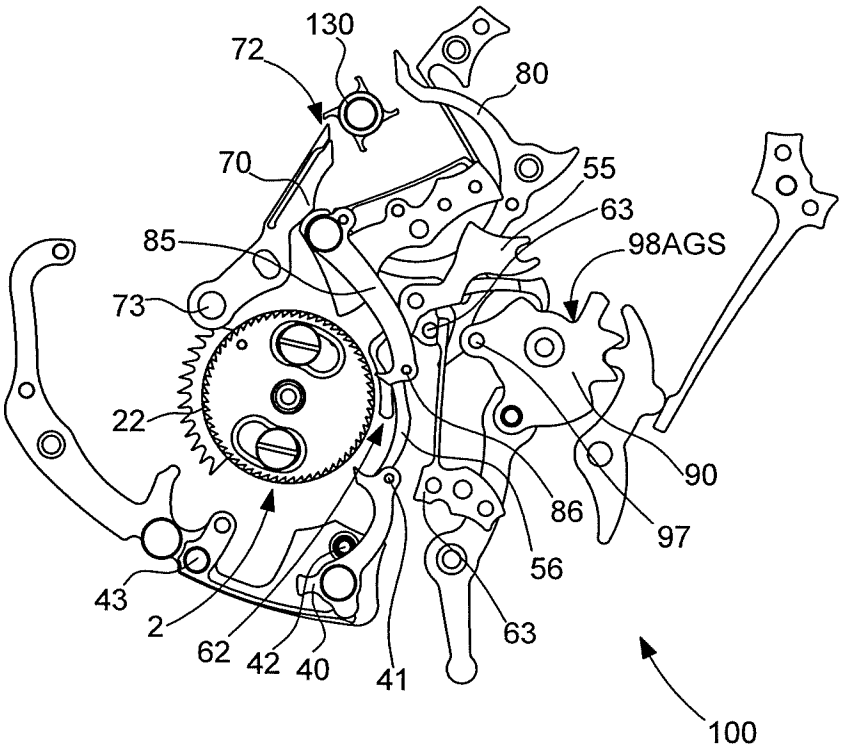
Figure 7:
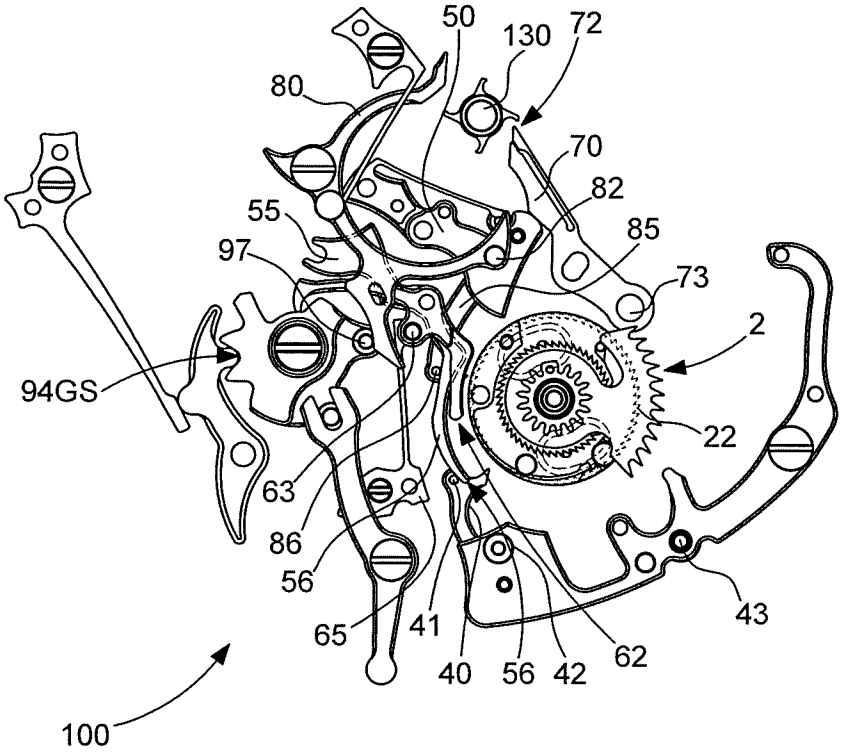

FIGS. 5 and 6 show mode selector 9 in the indexing position corresponding to silent mode notch 95, wherein the petite sonnerie and grande sonnerie mechanisms are uncoupled, but wherein it is possible to operate the minute repeater. Reading beak 61 of silencing lever 60 is resting on the largest radius 98S of peripheral shoulder 98 of cam 90, and consequently, on the one hand, petite sonnerie lever 80 is stopped by cam pin 97 and by spring 67, and on the other hand, main arm 64 of silencing lever 60 is in its farthest position from strike drive wheel set 2, and stops main click pin 86. On the other hand, strike uncoupling lever 55 is very close to strike drive wheel set 2, since there is nothing to obstruct this end position, and consequently minute repeater release click 40 is not hindered and can access detent ratchet 22, and the minute repeater can thus be operated as desired by the user, FIGS. 7 and 8 illustrate a stoppage in grande sonnerie mode and show mode selector 9 in the indexing position corresponding to grande sonnerie notch 94. Stopping mechanism 5 is arranged to uncouple all the clicks, when the amount of available energy, in the barrel(s) or suchlike, is insufficient. This time, reading beak 61 of silencing lever 60 is resting on the smallest radius 98AGS of peripheral shoulder 98 of cam 90, and, at its second end 62, main arm 64 of silencing lever 60 is in its closest position to strike drive wheel set 2, and cannot stop main click pin 86. On the other hand, strike uncoupling lever 55 is in its furthest position from strike drive wheel set 2, and consequently hinders both main pin 86 of main click 85 and repeater click pin 41, thus main click 85 and minute repeater release click 40 are hindered and cannot access detent ratchet 22. The minute repeater cannot be activated by the user. No striking function can therefore be activated. There is nothing to prevent mode selection lever 96 being moved into another position.

Figure 10:
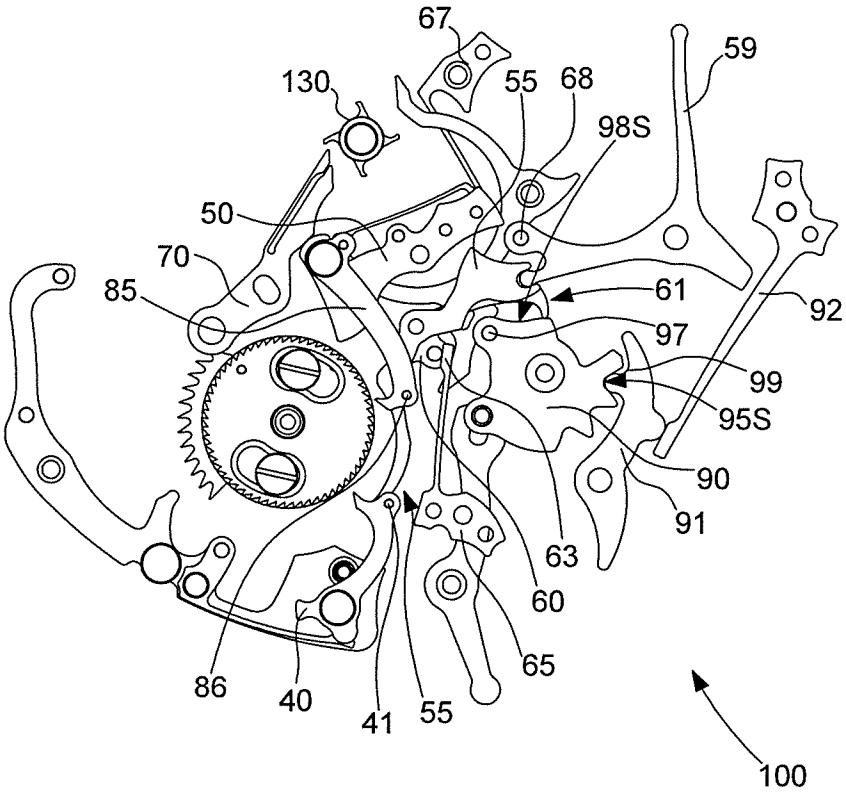
FIGS. 9 and 10 represent the striking mechanism according to the invention stopped in silent mode.
Figure 9:
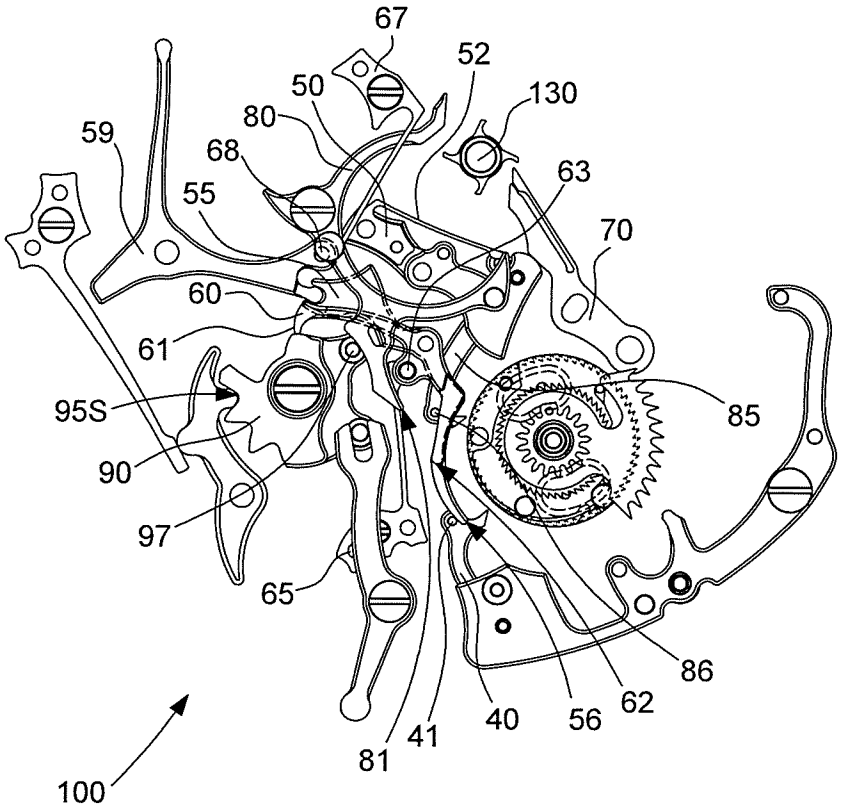
Figure 31:
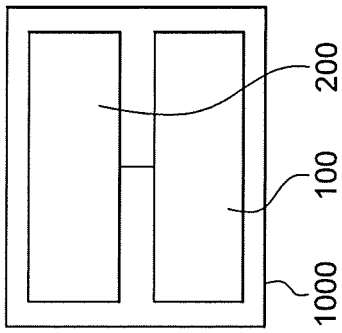
FIG. 31 is a block diagram which represents a watch comprising a striking mechanism according to the invention.
Figure 32:
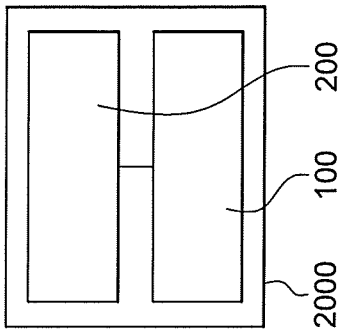
FIG. 32 is a block diagram which represents a musical timepiece comprising a striking mechanism according to the invention.
Figure 11:
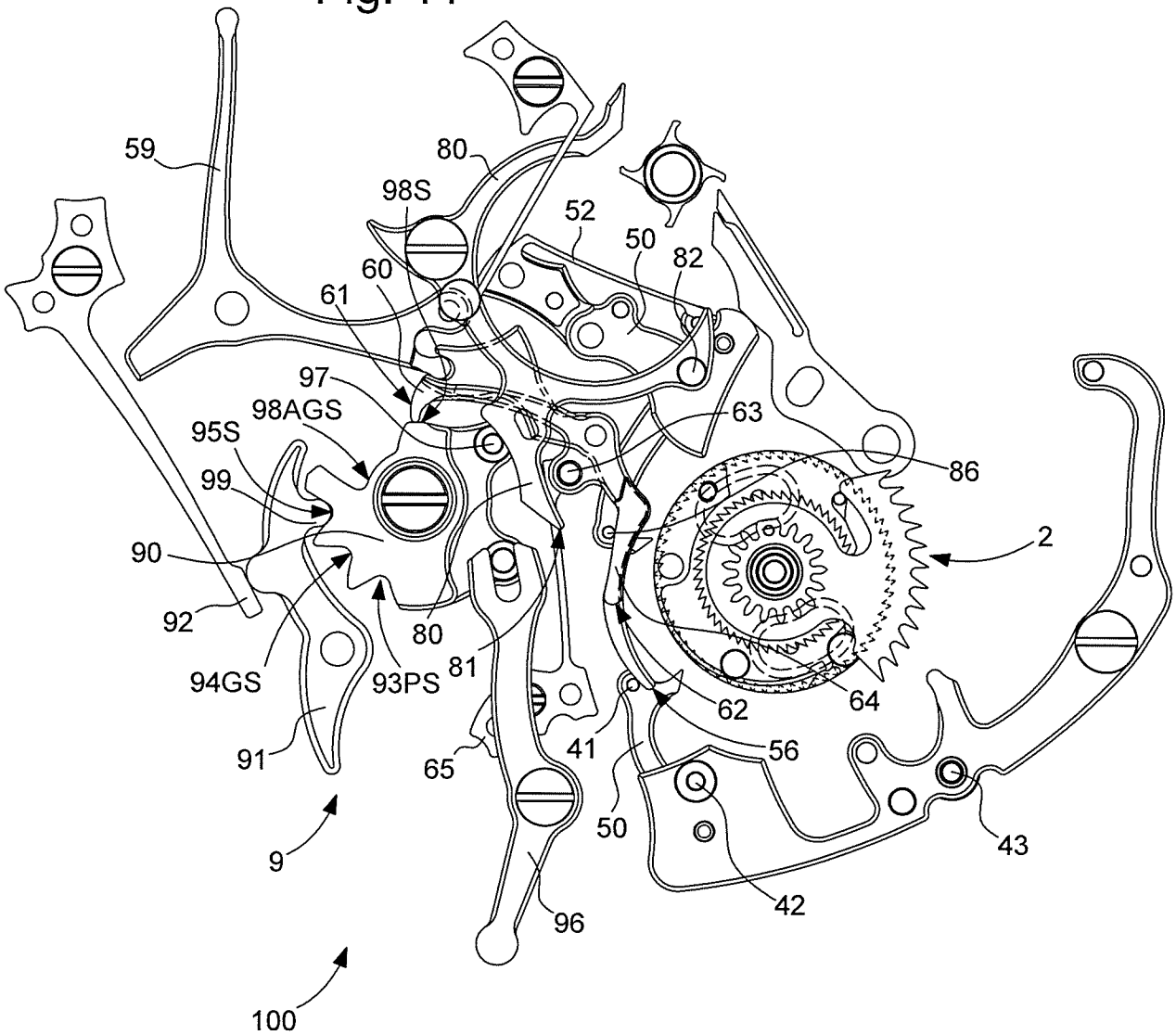
FIG. 11 is a detail of FIG. 9.
Figure 12:
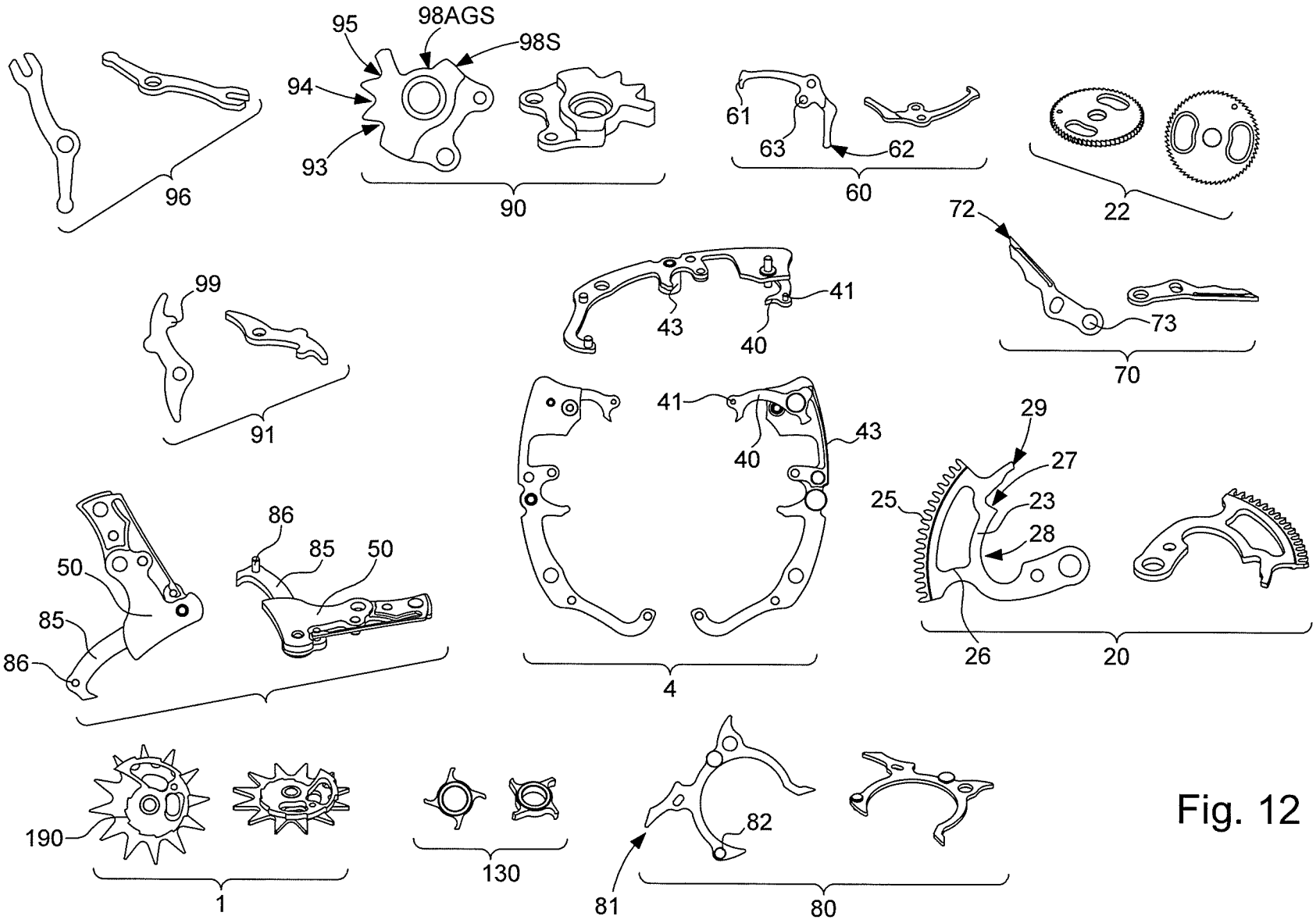
FIG. 12 is a schematic, plan view from both sides, of the panoply of main components of the striking mechanism according to the invention.
Figure 14:
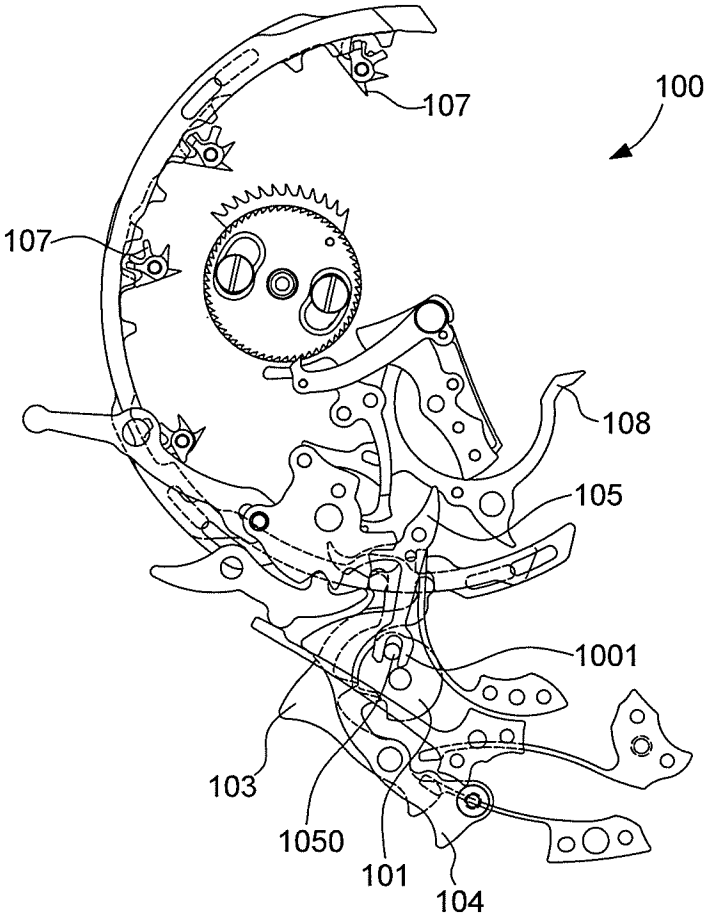
FIGS. 13 to 18 represent, in a similar manner to FIGS. 1 to 8, a first striking mechanism variant combining strike selection and mode selection according to the invention, for playing a first tune in petite sonnerie mode, and a second tune, different from the first tune, in grande sonnerie mode.
Figure 13:
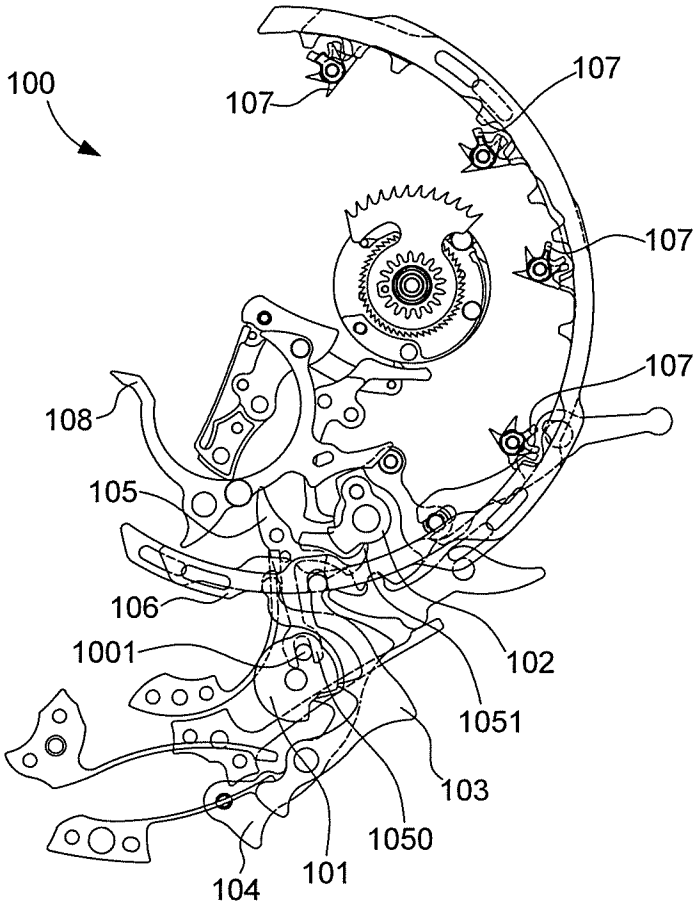
Figure 16:
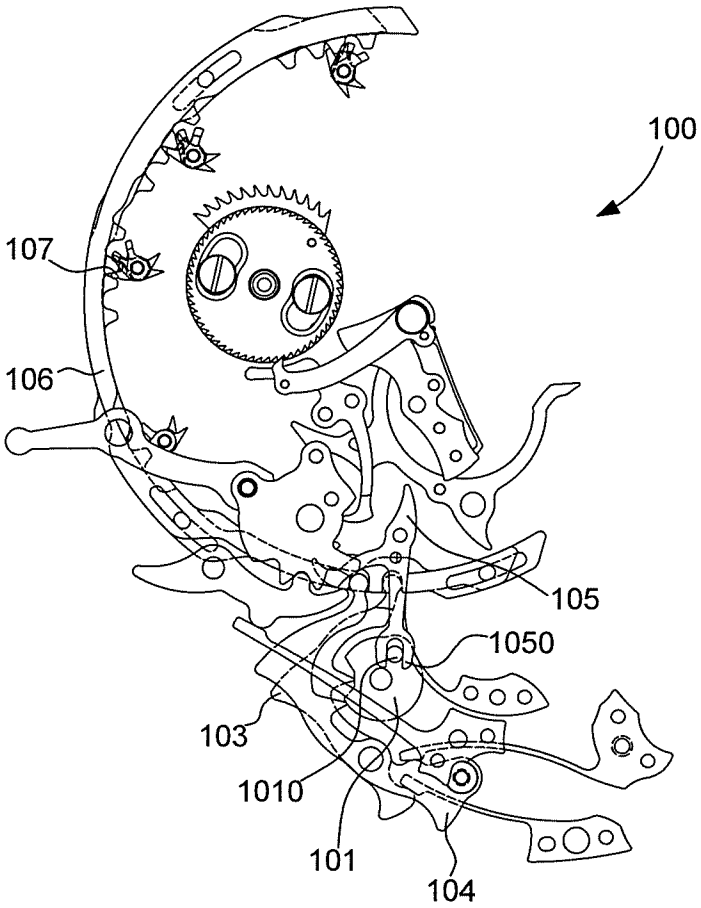
Figure 15:
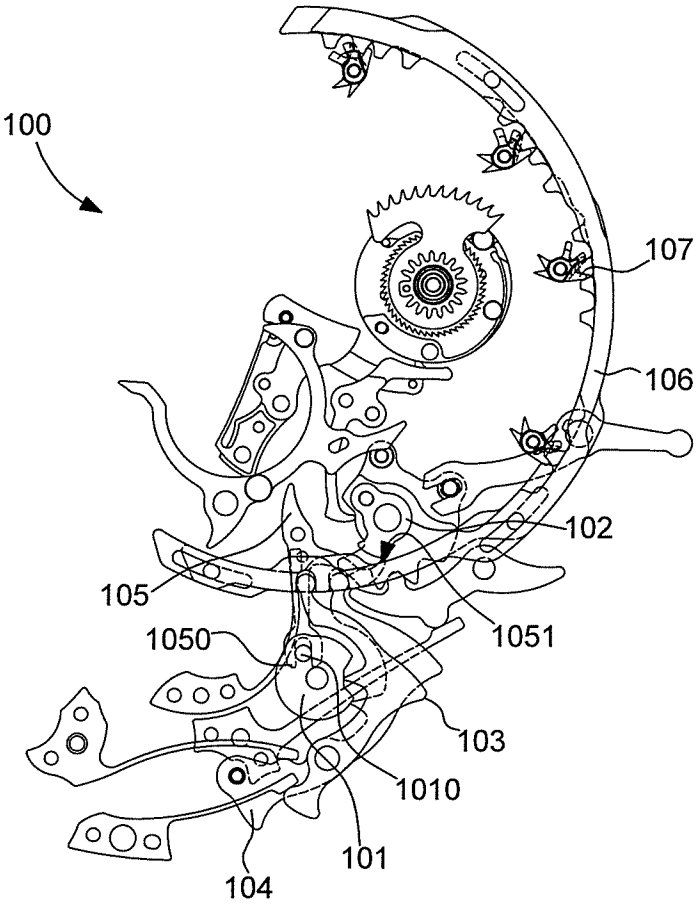
Figure 18:
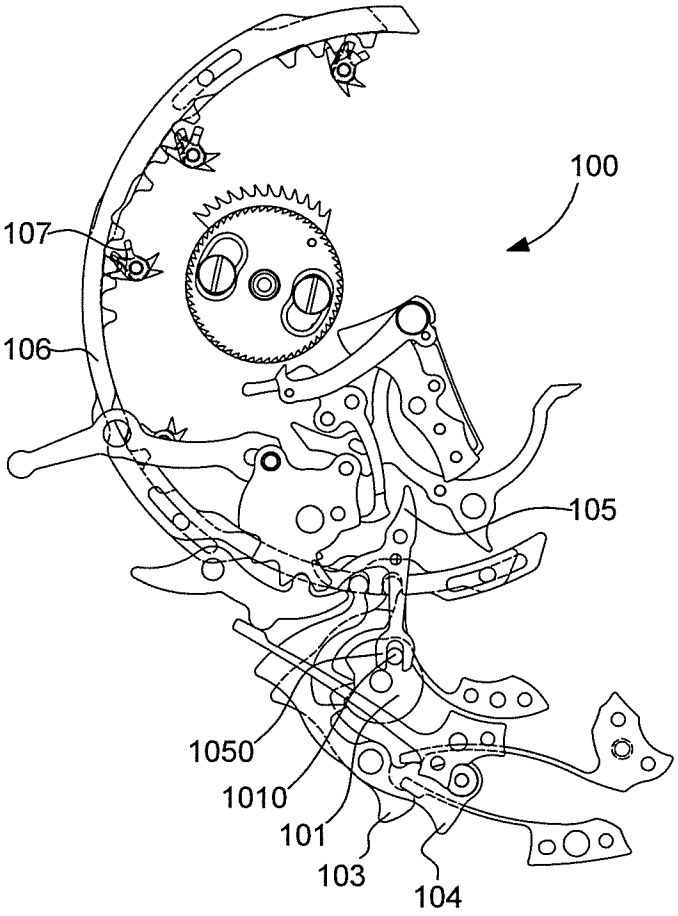
Figure 17:
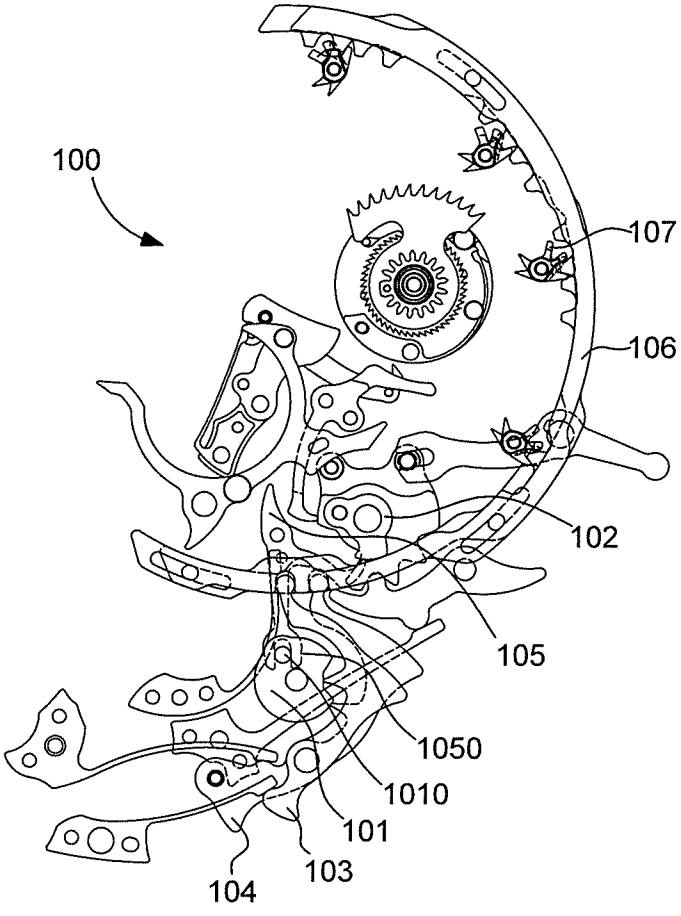
Figure 19:
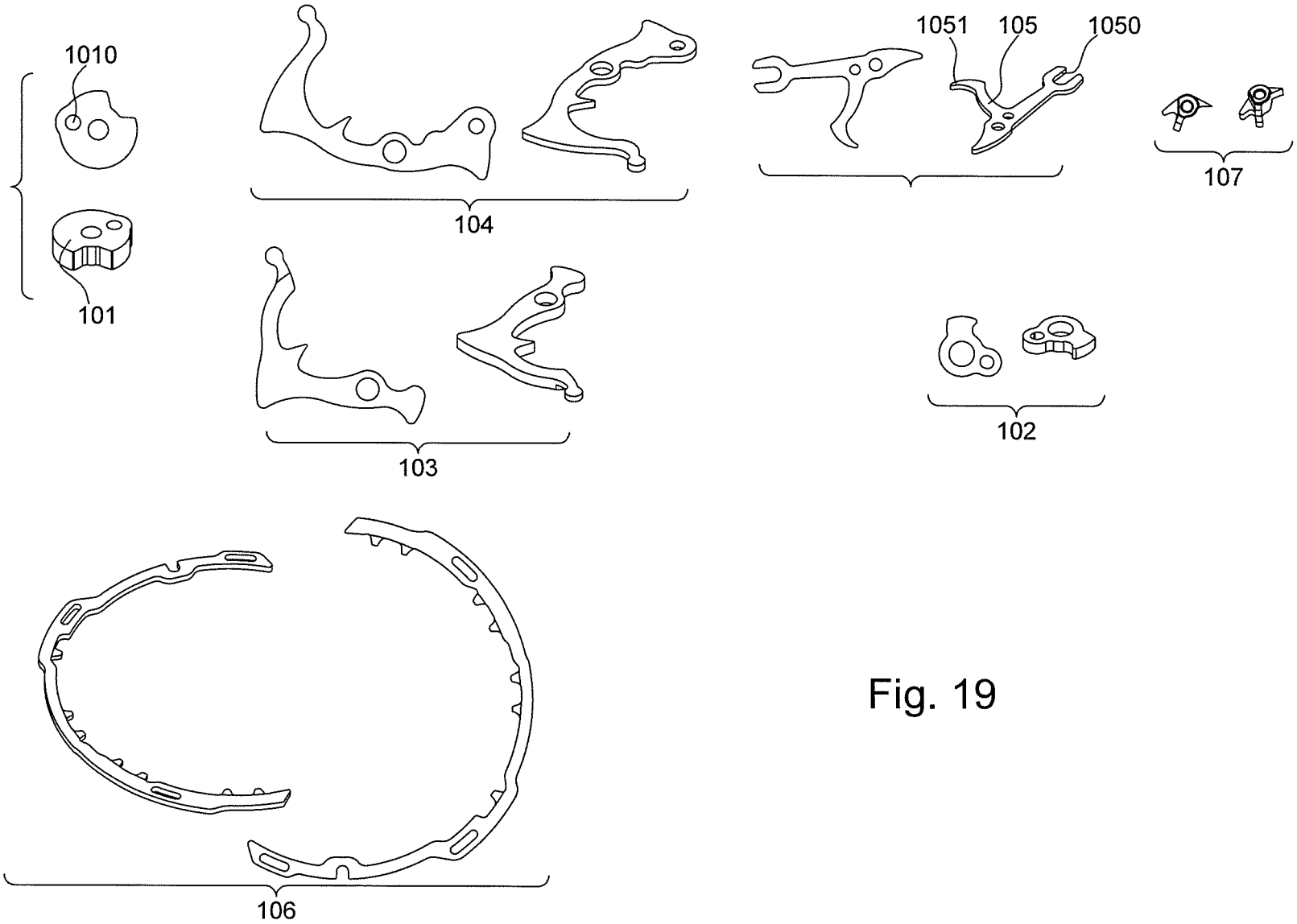
FIG. 19 is a schematic, plan view from both sides, of the panoply of main components of the striking mechanism of this first variant.
Figure 20:
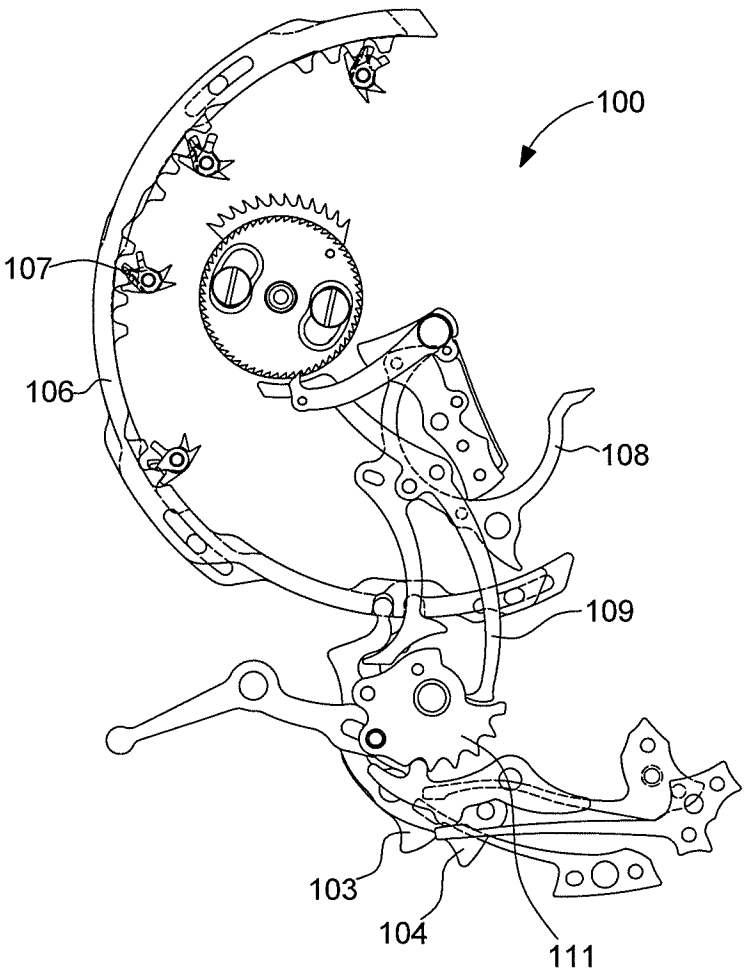
FIGS. 20 to 29 represent, in a similar manner to FIGS. 13 to 18, a second striking mechanism variant combining strike selection and mode selection according to the invention, wherein one or the other allows the first tune or the second tune to be played, in each strike mode.
Figure 21:
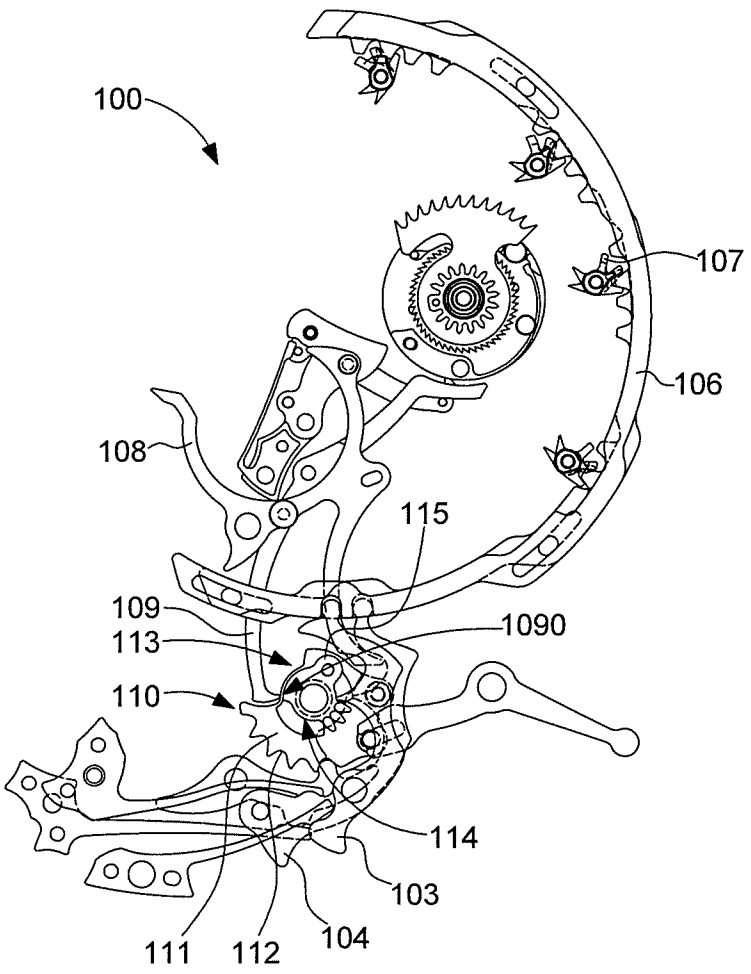
Figure 22:
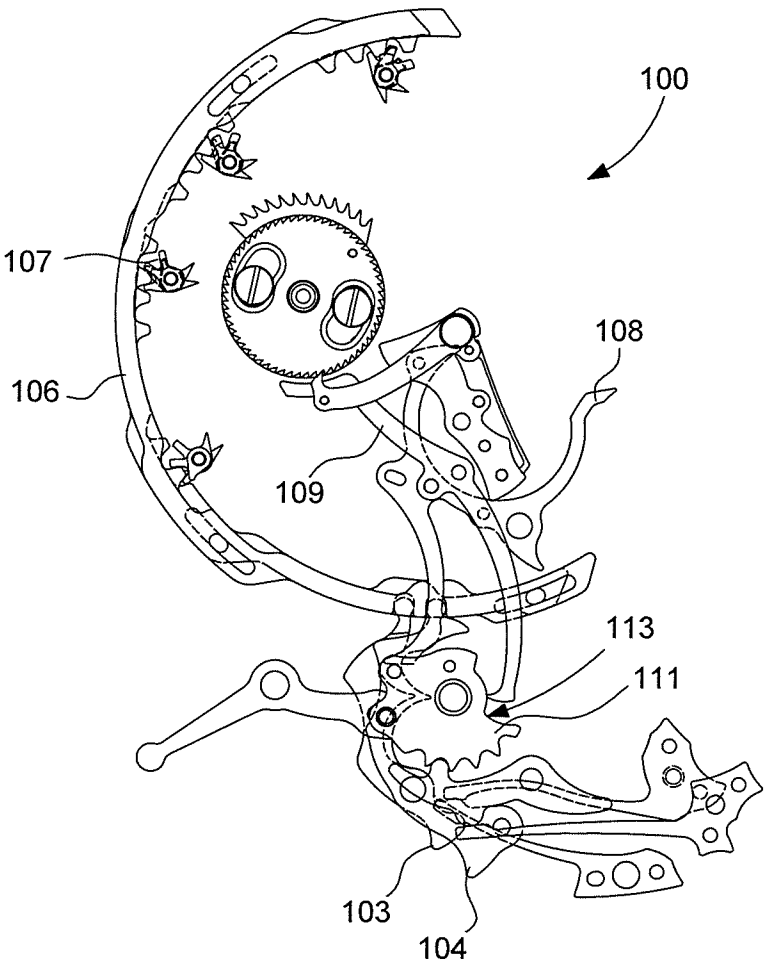
Figure 23:
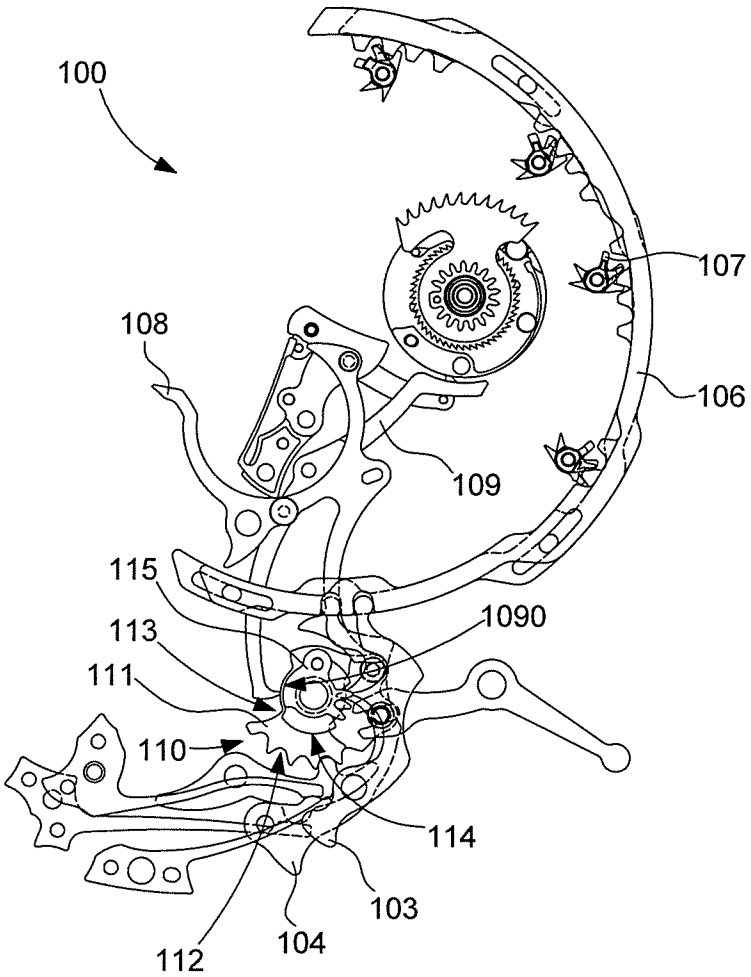
Figure 24:
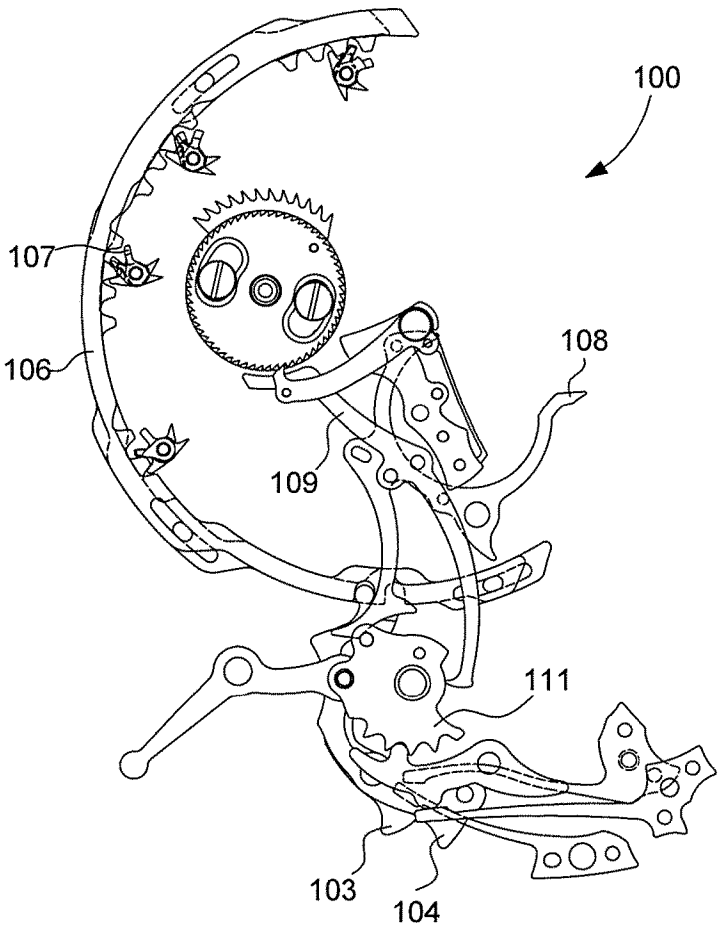
Figure 25:
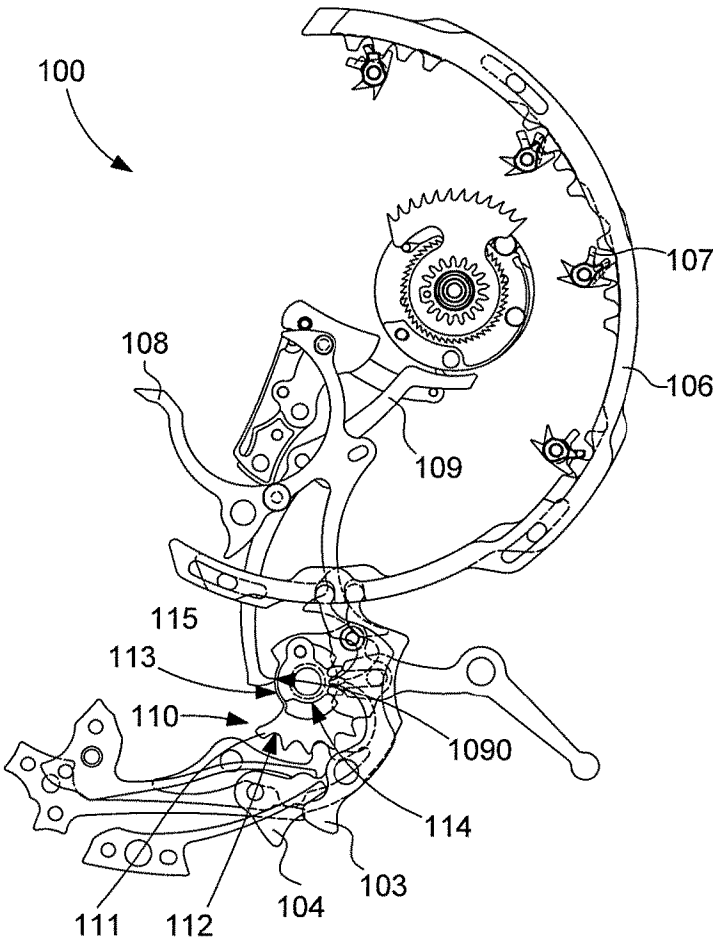
Figure 26:
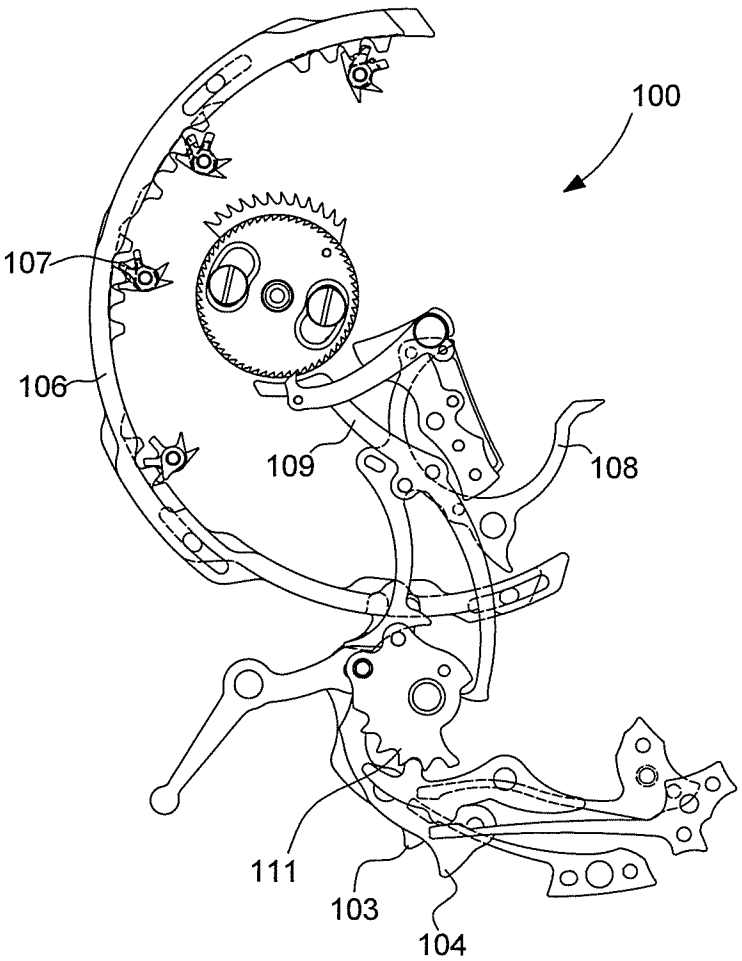
Figure 27:
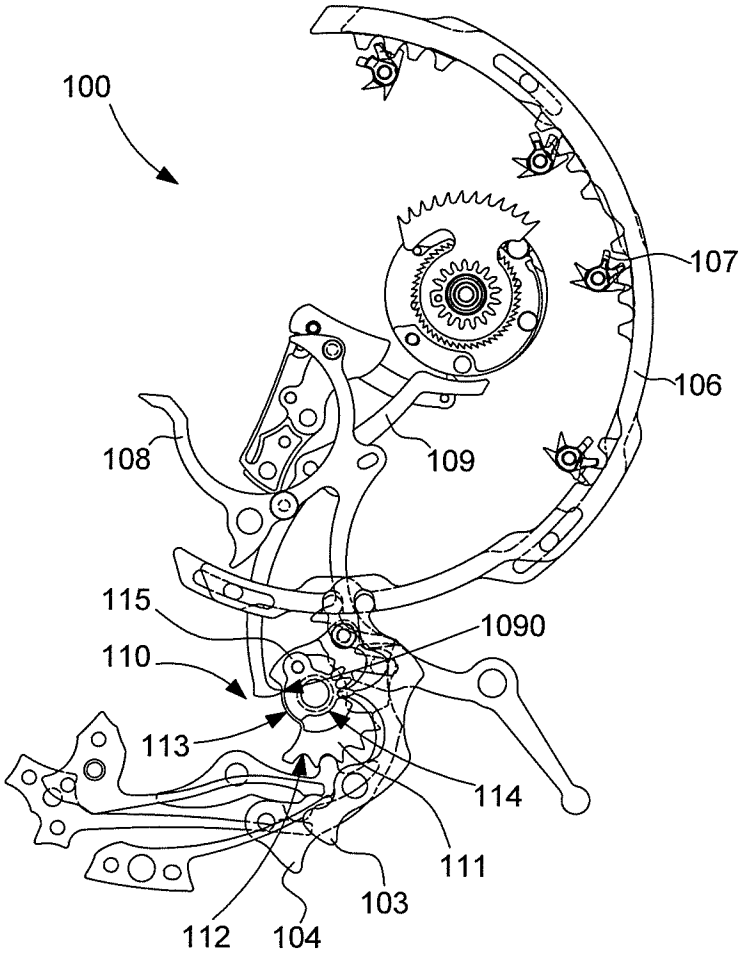
Figure 28:
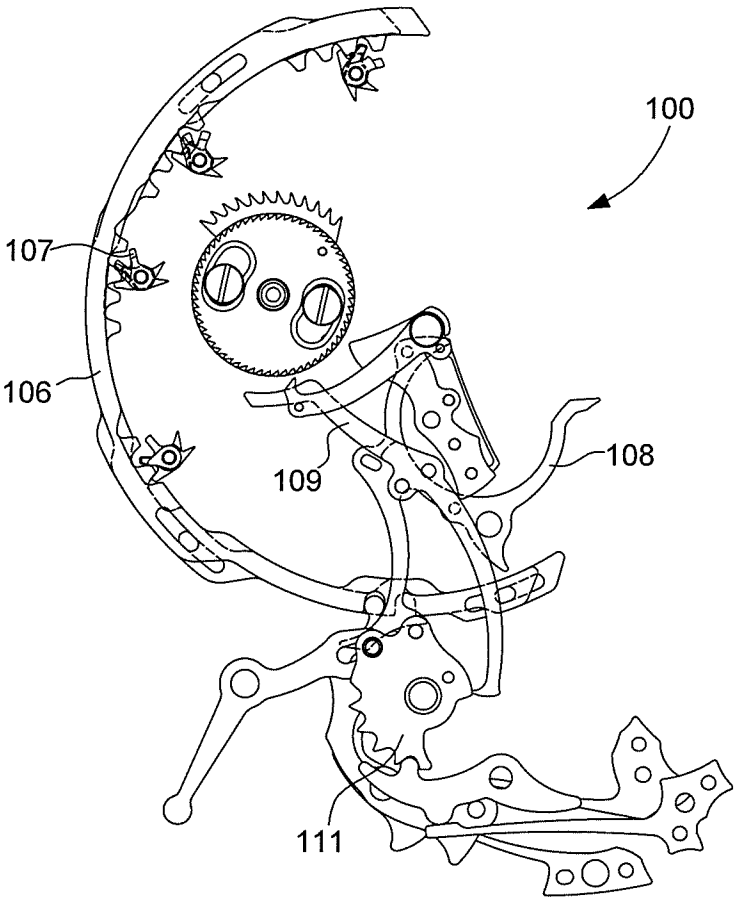
Figure 29:
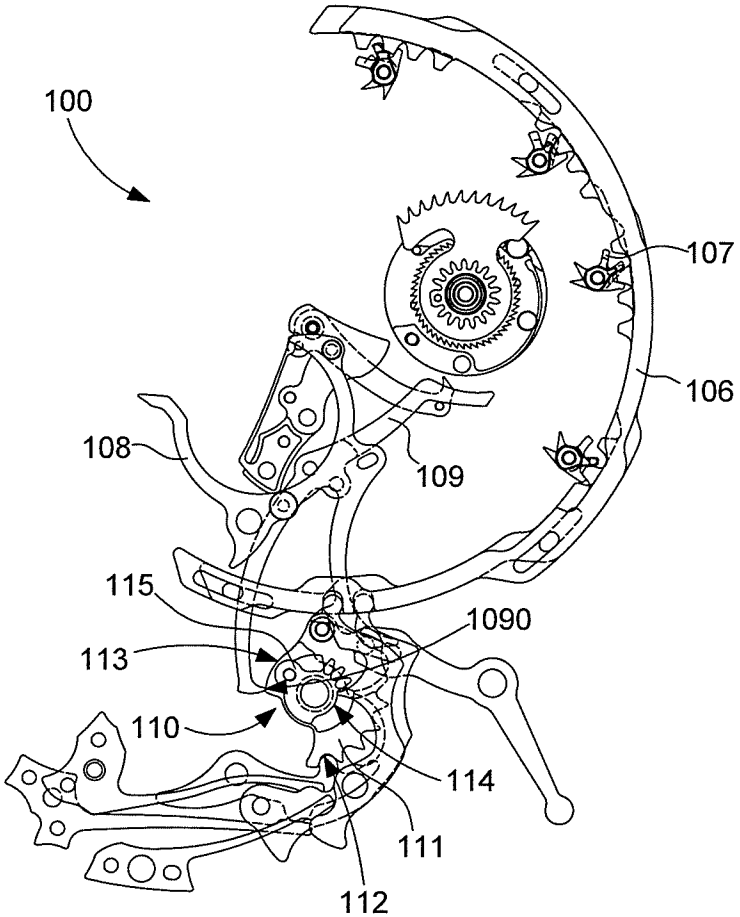
Figure 30:
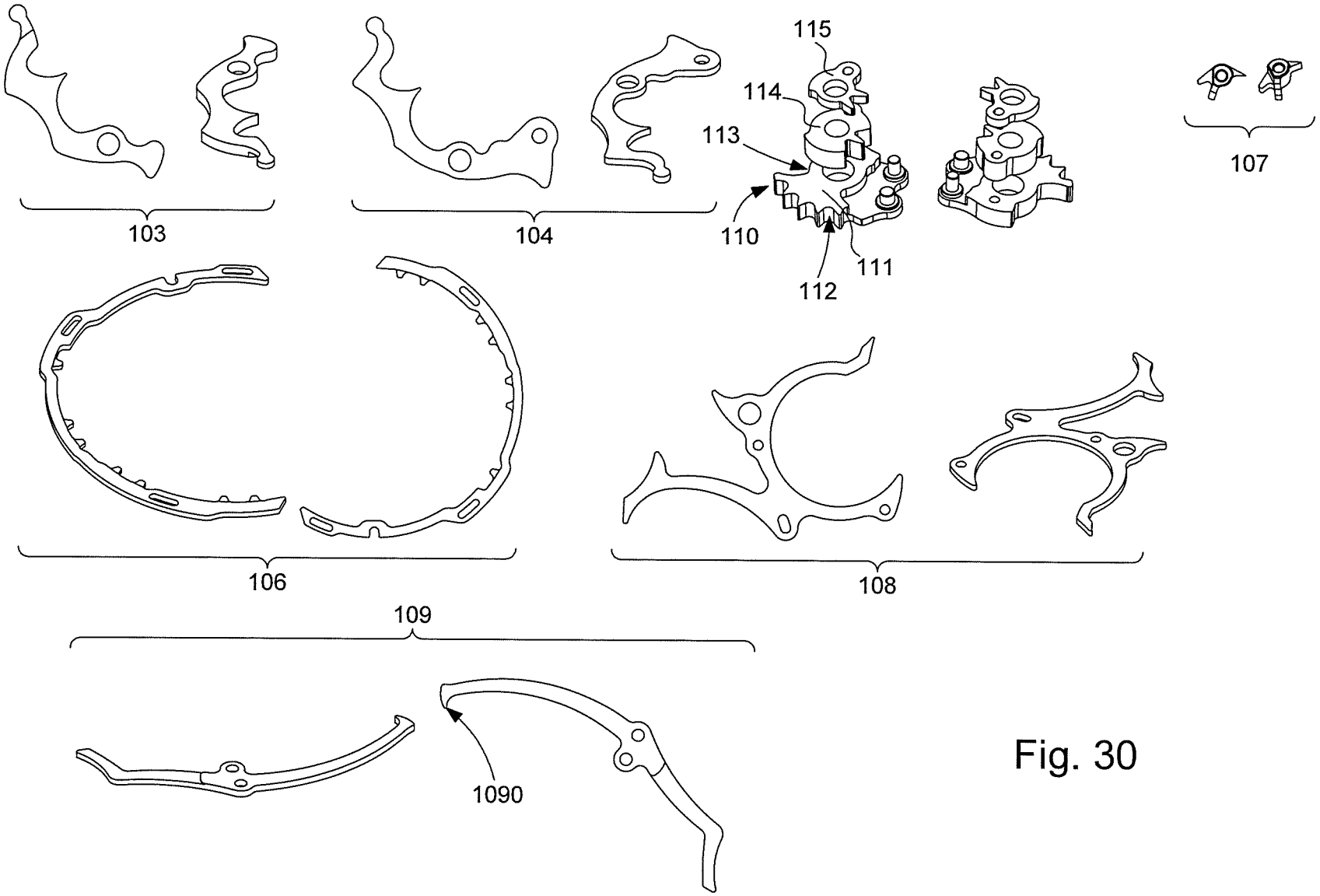
FIG. 30 is a schematic, plan view from both sides, of the panoply of main components of the striking mechanism of this second variant.

FIGS. 9 to 11 illustrate stoppage in silent mode and show mode selector 9 in the indexing position corresponding to silent mode notch 95. These Figures show an operating bolt 59 for the articulated control of strike uncoupling lever 55. Reading beak 61 of silencing lever 60 is resting on the largest radius 98S of peripheral shoulder 98 of cam 90, and the main arm 64 of silencing lever 60 is in its furthest position from strike drive wheel set 2, and stops main click pin 86. Strike uncoupling lever 55 is also in its furthest position from strike drive wheel set 2, and hinders repeater click pin 41. Thus, main click 85 and minute repeater release click 40 are hindered and cannot access detent ratchet 22.

It is clear that the stopping mechanism is only active when there is not enough energy and that, otherwise, this stopping mechanism is disconnected.

FIGS. 13 to 19 illustrate a first variant of the striking mechanism combining strike selection and mode selection according to the invention, allowing a first tune to be played in petite sonnerie mode, and a second tune, different from the first tune in grande sonnerie mode.

FIGS. 20 to 29 illustrate a second variant of the striking mechanism combining strike selection and mode selection according to the invention, wherein one or the other allows the first tune or the second tune to be played, in each strike mode.

It is understood that the only limitation is that of available space inside the watch or the musical timepiece: these first and second variants are each presented here with two tunes, but it is understood that the striking mechanism could play more tunes, or differentiate between the tunes on different sets of gongs or chimes, in combination with the teachings of European Patent No EP2947523B1 by the same Applicant, and European Patent Application Nos EP15190808.4, EP15168700.1, EP15183110.4, and EP16206572.6 by the same Applicant, the details of which are not repeated here. Likewise, mode selection can be performed by coaxial cams and/or juxtaposed cams in one plane.

The first variant includes a tune selection cam 101, which cooperates with a first tune lever 103 and a second tune lever 104, which in turn cooperate with a tune selector 106, arranged to control the different gathering pallets 107. Each of these levers 103 and 104 includes an intermediate feeler beak, which runs over the periphery of tune selection cam 101. Tune selection cam 101 includes a pin 1010, which drives fork 1050 of a tune selection feeler arm 105, one of whose fingers 1051 cooperates with the periphery of a tune selection-by-mode cam 102. The latter is in the same plane here as tune selection cam 101.

The second variant includes, in a similar manner, a first tune lever 103 and a second tune lever 104, which cooperate in turn with a tune selector 106, arranged to control the various gathering pallets 107.

Mode and tune selection is controlled here by a control wheel set 110 which includes several cams stacked one on top of the other.

At the lower level, a first cam 111 is similar to the cam 90 presented above, and includes jumper notches 112, and control of the petite sonnerie, grande sonnerie and silent modes by its peripheral contour 113, followed by a beak 1090 of a passing strike isolator 109, arranged to prevent any interference between a minute repeater function and a passing strike.

Each of levers 103 and 104 includes an intermediate feeler beak, which runs over the periphery respectively of a first cam 114 controlling the first tune and a second cam 115 controlling the second tune.

This control wheel set 110 is extremely compact and uses less height space than strike wheel set 2.

It is seen that these different variants use many common components, which reduces production costs that are always high for large complications. The invention therefore provides the possibility of creating a wide variety of differentiated striking functions, either controlled by the watch or timepiece movement 200 for automatic striking, for example day/night, AM/PM, weekly non-working days, or otherwise, or controlled by a user as he sees fit.

The invention also concerns a watch 1000 comprising a movement 200 including an output 3 for releasing a passing strike function by the movement, this movement 200 being arranged to drive at least one reference wheel set 1, and watch 1000 includes at least one such striking mechanism 100.

The invention also concerns a timepiece 2000 comprising a movement 200 including an output 3 for releasing a passing strike function by the movement, this movement 200 being arranged to drive at least one reference wheel set 1, and watch 2000 includes at least one such striking mechanism 100.

What is claimed is:

1. A striking mechanism for a watch or timepiece comprising a movement, said striking mechanism including at least one reference wheel set arranged to be driven by a said movement and wherein at least one said reference wheel set is an hour snail, at least one strike drive wheel set including a detent ratchet and a repeating rack pinion, said striking mechanism including at least one pivoting part, arranged to cooperate indirectly with an output of a said movement, including a feeler arm for reading a said reference wheel set and a rack for driving said repeating rack pinion, one of said pivoting parts being an hour-rack arranged to cooperate with said hour snail, said striking mechanism further including main click arranged to be set in motion at each passing strike and to drive said detent ratchet, and said striking mechanism being able to operate in at least two distinct strike modes including a silent mode, wherein said striking mechanism includes a mode selector mechanism, comprising a user-accessible selector which allows the user to choose which strike mode to use, and which controls the angular position of at least one cam, which has specific positions for different modes, said cam including a continuous, external, feeler arm support profile, arranged to cooperate with a beak comprised in a silencing lever, and which includes an area of larger radius corresponding to said silent mode, arranged to orient said silencing lever into a position wherein a main arm of said silencing lever moves said main click away from said detent ratchet, in order to disable every passing strike in silent mode, wherein said mode selector mechanism includes at least one said flat cam, which includes notched portions each corresponding to one of the selectable modes, and wherein said notched portions correspond to notches of variable size, requiring increasing force in one of the two directions of operation.

2. The striking mechanism according to claim 1, wherein said mode selector mechanism includes at least one said cam, which can have as many specific positions as there are designated modes of the striking mechanism, or which has positions specific to only certain of said modes.

3. The striking mechanism according to claim 1, wherein one particular notch, at the centre or close to the centre, is larger than the end notches, so as to ensure safety by preventing the user from inadvertently changing from one strike mode to another.

4. The striking mechanism according to claim 1, wherein said mode selector mechanism includes at least one said cam arranged to differentiate between the different tunes played and/or the set of different gongs.

5. The striking mechanism according to claim 1, wherein said mode selector mechanism includes at least one said cam including multiple notches for differentiating between tunes and/or gongs assigned to each strike mode.

6. The striking mechanism according to claim 1, wherein said mode selector mechanism includes a plurality of cams which are superposed or juxtaposed in one plane.

7. The striking mechanism according to claim 1, wherein said mode selector mechanism is arranged to disable the striking mechanism in silent mode, by moving said main click away from said strike drive wheel set, and by preventing access by said hour-rack to said hour snail.

8. The striking mechanism according to claim 1, wherein said striking mechanism includes a minute repeater with a minute repeater control device including a repeater click, arranged to drive said detent ratchet once said hour-rack has performed a reading on said hour-snail, and wherein, in said silent mode, said main arm of said silencing lever allows said repeater click access to said detent ratchet, provided that the energy available is sufficient to complete a striking function.

9. The striking mechanism according to claim 8, wherein said striking mechanism includes a stopping mechanism arranged to pivot a strike reversing lever when the energy available is insufficient to complete a striking function, and wherein said strike reversing lever controls the pivoting of a strike uncoupling lever arranged to prevent access by said repeater click to said detent ratchet when the available energy is insufficient to complete a striking function, and to move said main click away from said detent ratchet when the available energy is insufficient to complete a striking function.

10. The striking mechanism according to claim 1, wherein said striking mechanism includes a grande sonnerie mode for the passing strike of each hour, and of each quarter hour, repeating the hour at the quarter hour, and a petite sonnerie mode for the passing strike of each hour and of each quarter hour without repeating the hour at the quarter hour, and wherein said striking mechanism includes a petite sonnerie lever arranged to cooperate in abutment with a cam pin comprised in said cam of said mode selector mechanism, in order, when the petite sonnerie mode is selected, to orient the petite sonnerie lever into a position in which the latter prevents said hour-rack moving towards said hour-snail, to prevent the hours being struck on the quarter hours.

11. The striking mechanism comprised in said striking mechanism according to claim 10, wherein said striking mechanism includes, coaxial to a four-tooth star driven by said output and which is arranged to release passing strikes on the quarter hours, a tear-shaped hour cam, comprising a tip arranged to lift said petite sonnerie lever and to allow said hour-rack to move towards said hour-snail.

12. The striking mechanism according to claim 10, wherein, when grande sonnerie mode is selected, said cam pin orients said petite sonnerie lever into a position in which the latter allows hour-rack 20 to move towards said hour-snail, to allow the hour to be struck on the quarter hours.

13. A watch comprising a movement including an output for releasing a passing strike function by the movement, said movement being arranged to drive at least one reference wheel set, and said watch including at least one said striking mechanism according to claim 1.

14. A timepiece comprising a movement including an output for releasing a passing strike function by the movement, said movement being arranged to drive at least one reference wheel set, and said timepiece including at least one said striking mechanism according to claim 1.

* * * * *